US007201629B2

(12) United States Patent
Lambru

(10) Patent No.: US 7,201,629 B2
(45) Date of Patent: Apr. 10, 2007

(54) WASHABLE COSTUME SYSTEM AND METHOD OF MANUFACTURE

(76) Inventor: Angela Lambru, 336 E. 61 #5, New York, NY (US) 10021

( * ) Notice: Subject to any disclaimer, the term of this patent is extended or adjusted under 35 U.S.C. 154(b) by 0 days.

(21) Appl. No.: 11/208,841

(22) Filed: Aug. 22, 2005

(65) Prior Publication Data

US 2005/0273899 A1 Dec. 15, 2005

Related U.S. Application Data

(63) Continuation of application No. 10/346,786, filed on Jan. 17, 2003, now abandoned.

(51) Int. Cl.
*A41C 3/08* (2006.01)
*A41C 3/00* (2006.01)
*A41C 3/12* (2006.01)

(52) U.S. Cl. ..... 450/1; 450/23; 450/26; 2/310; 2/312

(58) Field of Classification Search ..... 450/1–11, 450/14, 23, 26, 28, 30–33, 86, 88, 92, 93; 224/224, 648, 649, 665–667, 904; 2/310–322, 2/338, 340, 300, 301, 67, 69, 102, 113–115, 2/105, 106, 109, 110, 244, 246
See application file for complete search history.

(56) References Cited

U.S. PATENT DOCUMENTS 2,869,552 A * 1/1959 Smith ..... 450/32
4,089,068 A * 5/1978 Swallow ..... 2/76
5,413,262 A * 5/1995 Dewire et al. ..... 224/675
5,416,928 A * 5/1995 Koenig ..... 2/244
5,464,136 A * 11/1995 Eddy ..... 224/666
5,852,829 A * 12/1998 Relaford ..... 2/338
6,041,436 A * 3/2000 Keen ..... 2/69
6,339,848 B1 * 1/2002 Mayhood et al. ..... 2/338
6,678,898 B2 * 1/2004 Jones et al. ..... 2/321
6,701,534 B2 * 3/2004 Guibord ..... 2/338

* cited by examiner

*Primary Examiner*—Gloria M. Hale
(74) *Attorney, Agent, or Firm*—Jennifer Meredith, Esq.; Meredith & Keyhani, PLLC

(57) ABSTRACT

The present invention provides a system, method of manufacture and method of use that provides for an easily changeable costume system that allows for quick costumes changes without having to entirely undress and allows for the purchase of add on decorative items to allow for costume changes without having to buy an entirely new costume. According to a preferred embodiment, an interchangeable costuming system is disclosed comprising: a washable foundation with a plurality of first ends of an attachment device fixedly attached; and at least one non-washable decorative cover with at least two second ends of an attachment device fixedly attached. The second ends of the attachment device are intended to removably attach the non-washable decorative cover to the washable foundation so as to provide a washable garment with a non-washable decorative cover. Additional decorative items may be added on.

9 Claims, 5 Drawing Sheets

WASHABLE COSTUME SYSTEM AND METHOD OF MANUFACTURE

BACKGROUND OF THE INVENTION

This is a continuing application and claims priority to application Ser. No. 10/346,786 filed Jan. 17, 2003 now abandoned.

The present invention generally relates to costumes for theater and belly dancing. Specifically, the present invention provides an interchangeable and washable costume system and method of manufacture. Belly dancing and theatrical costumes can be extremely costly. For example, belly dancing costumes can cost around $900–$1,500. Also, performers may be required to wear a number of different costumes for a single show. For performers, this can be very cost prohibitive. Another problem is that a performer may be required to do a number of costume changes very quickly. It may be undesirable to entirely disrobe and change costumes for a number of reasons. Firstly, the time required to change may be viewed as too long. Second, a performer pressed for time may be required to entirely disrobe in front of everyone backstage to change his or her outfit in time to get back out on stage. Changing outfits may, therefore, be undesirable for a number of reasons. Because of this, it would be desirable to provide a costuming system that is capable of being easily interchanged.

Known within the art are articles of clothing that provide interchangeable straps and portions. For example, Hall, U.S. Pat. No. 5,211,598, discloses an exercise brassiere having an outer layer adapted to fit over the wearer's upper torso and shoulders. The inner layer and the outer layer are constructed of lightweight, stretchable fabrics. The inner layer has cut-outs for receiving the breasts of the wearer. A middle layer may be provided for extra comfort. A covering layer may be included to cover the outer layer. The covering layer may be constructed of a decorative fabric, suitable to the taste of the wearer, so that the exercise brassiere can be worn alone as a top. A decorative fabric ruffle may be attached along the seam extending about the neck opening.

Koenig, U.S. Pat. No. 5,416,928, discloses a garment attachment that can be attached to clothing. The garment attachment is a decorative, flexible panel that can be attached to clothing. The device is attached to clothing by plurality of snap fasteners.

Laudick, U.S. Pat. No. 5,842,230, discloses a halter top made from a portion of a pair of pants. The connecting straps are formed from material removed from the pants and attached in a configuration such that the former back pockets from the pants make up the cups of the halter top or bra and cover the wearer's breasts. The shoulder and side straps are trimmed to a desired length from the seam of the pants.

Hopps, U.S. Pat. No. 4,957,466, discloses a support garment having a multi-layered rectangular front panel and a back panel and two adjustable shoulder straps interconnecting the front panel and the back panel and extending about a wearer's shoulder. The support garment can be worn in place of a bra, or over existing clothing or even as an outer garment. The straps are of a wide design to help disburse strain. The straps may be adjustable. The straps are fixed to the back panel and are provided with hook and loop fasteners to interconnect with matching hook and loop fasteners located on the interior surface of the front panel.

It is also known to provide strapless bras, i.e. bras with a body portion but no straps, as well as tank tops with adjustable straps. Additionally, it is known to provide tank tops with removable straps so that the tank top can be converted to a tube top. Also, it is known to provide a bra with straps which are detachable from the bra body at the back end, and attachable together to form a "halter" style bra.

While it is known to provide bras and the like with added and removable straps, it is submitted that none of the prior art disclose all of the elements of the present invention, nor do they disclose all of the benefits of the present invention. In particular, heretofore there has not yet been a system, method of manufacture and method of use that provides for an easily changeable costume system that allows for quick costumes changes without having to entirely undress and allows for the purchase of add on decorative items to allow for costume changes without having to buy an entirely new costume.

SUMMARY OF THE INVENTION

The present invention provides a costuming system and method for manufacture. It may be utilized for professional showgirls, oriental dancers, belly dancers, theatrical costumes and the like. An intention of the present invention is to get more wear out of these expensive costumes, by making them washable and. interchangeable, thus adding more versatility, reducing the costs of costumes and facilitating quick costume changes for dancers on the stage.

According to one aspect of the present invention, an interchangeable costuming system is disclosed comprising: a washable foundation with a plurality of first ends of an attachment device fixedly attached to the washable foundation; and a non-washable decorative cover with at least two second ends of an attachment device fixedly attached thereto, wherein the second ends of the attachment device are intended to removably attach the non-washable decorative cover to at least one of the first ends of an attachment device fixedly attached to the washable foundation so as to provide a washable garment with a non-washable decorative cover. It should be noted that the non-washable is limited to dry clean only items or items that are not washed at all. The term "attachment devices" describes what are commonly referred to in the art as fastener components, where the first and second ends are complementary and connect together.

According to a further aspect of the present invention, a garment and a plurality of attachable accessories comprising an interchangeable garment set is disclosed. The garment set may have a brassiere foundation with a plurality of attachment device first ends and at least one decorative cover. Each decorative cover has at least one second end of an attachment device for removably attaching the decorative cover to the brassiere foundation.

According to yet another embodiment, a method for manufacturing an interchangeable costume garment set is disclosed. The steps may be: providing a washable foundation; fixedly attaching a plurality of first ends of a plurality of attachment devices to the washable foundation; providing at least one non-washable decorative cover; fixedly attaching at least two second ends of the plurality of attachment devices to each non-washable decorative cover; providing at least one decorative item with at least one second end of the attachment devices fixedly attached thereto; and fixedly attaching at least one second end of the attachment device to each at least one decorative item.

According to still yet another embodiment, a method of utilizing an interchangeable costume system is disclosed, comprising the following steps: selecting a washable foundation with a plurality of first ends of attachment devices fixedly attached thereto; selecting a decorative non-washable cover with at least two second ends of the attachment devices attached thereto; and removably attaching at least two second ends of the attachment devices of the decorative non-washable cover to the first ends of the attachment devices attached to the washable foundation so as to provide a costume system wherein a number of different decorative non-washable covers may be utilized with a single washable foundation.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

As discussed previously, belly dancers, professional and theatrical performers of all types often need to change outfits quickly, and a number of times throughout a single performance. Another problem is the cost of performance costumes. Many performers can not afford a number of different costumes. Because of this, it is desirable to provide a system, method of manufacture and method of use that provides for an easily changeable costume and allows for the purchase of add on decorative items to provides changes in the costume without having to buy an entirely new costume. It is also envisioned that the systems and methods may provide novelty lingerie items.

Figure 1A:
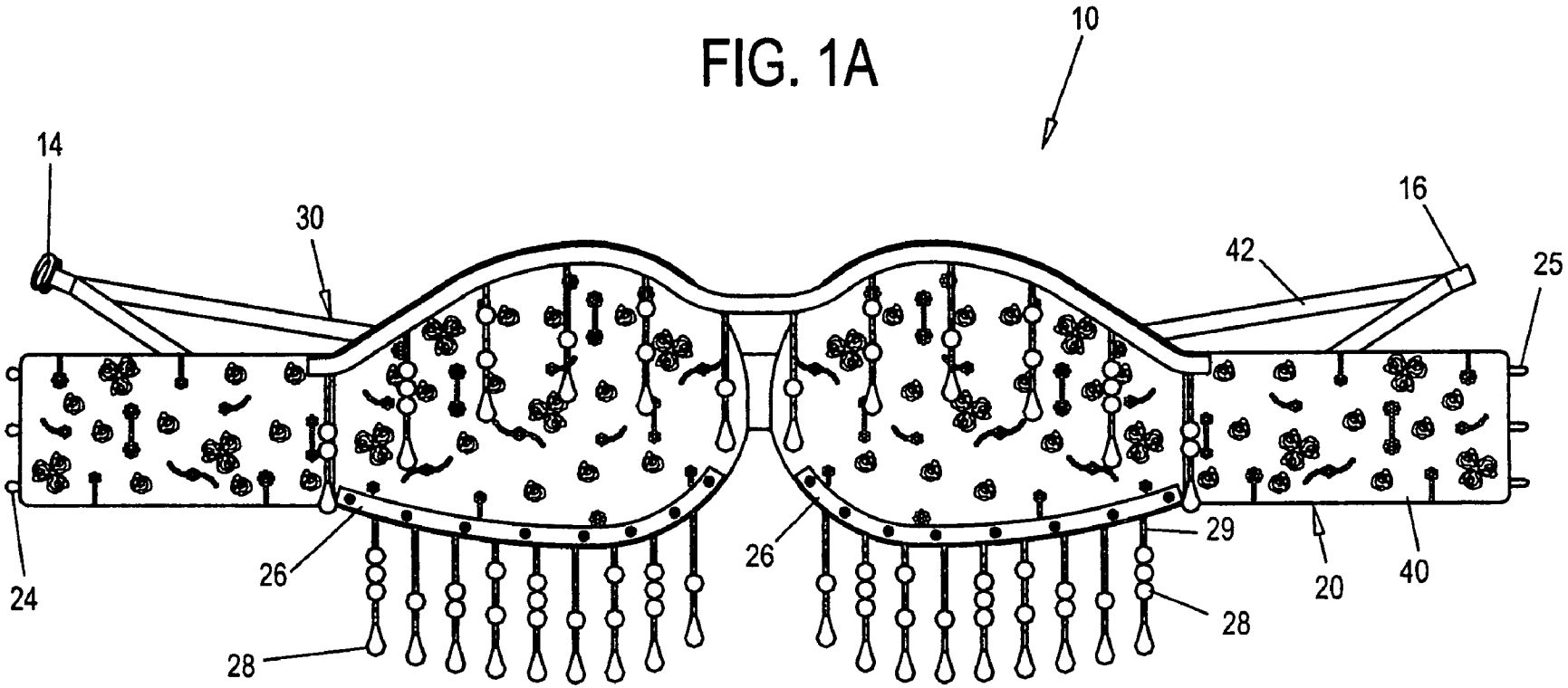
FIG. 1A is a front view of brassiere according to the present invention.

FIG. 1A illustrates the current invention according to a preferred embodiment. Shown is the costuming system 10. The costuming system 10 is composed of three separate garments according to this embodiment. The washable foundation 30 is manufactured of a washable material. The washable foundation 30 may be a brassiere, sash, belt, scarf, shawl, hip scarf, skirt or the like. According to the embodiment shown, the washable foundation 30 acts to provide a firm and comfortable position for the bra, around the chest of the user. At one end of the washable foundation 30 may be a clasp end 14, while a loop 16 may exist at the opposite ends. These devices provide a simple means for closure of the washable foundation 30 around the torso of the user. In removably or detachable connection with the washable foundation 30 is the decorative costume cover 20. The decorative costume cover 20, having two functional surfaces, provides for a visible costume for the user. Decorative materials, not limited to those present, may form the outside (visible) surface. In this case, ornamental beads 40 line the outside surface of the decorative covering 20. According to one embodiment, the second ends of the attachment device fixedly attached to the decorative costume cover 20 are removably attached to the first ends of the attachment device fixedly attached to the washable foundation. The attachment device may take a number of different forms, including hook and eye, snaps, VELCRO™, zippers, buttons, ziploc™, button and tape. It is also envisioned that a second decorative cover may be placed over the decorative cover. This allows for quick change. For example, a performer may perform a first act with the second decorative cover showing, then quickly remove the second decorative cover to show the first decorative cover. Of course, a multitude of decorative covers may be added, and a layer removed for each costume change. The maximum number of decorative covers will depend on the material used. It should also be noted, that snaps on the outside of a first decorative costume cover may be used to attach decorative items or another decorative cover. The decorative costume cover 20 has two sides and may have attachment devices on both sides.

There may also be a decorative item attached to a portion of the costume. As shown, there is a fringe strip 26 With fringe 28 also removably attached to the washable foundation 30, adding to the ornamental quality of the invention. It is desirable that the fringe strip 26 be between the washable foundation 30 and the decorative costume cover 20, so that the fringe strip 26 is not visible. The fringe 28 should hang so as to be visible. To accomplish this task, the fringe strip may have a second end of an attachment device fixedly attached to one side and a first end of an attachment device fixedly attached to the other side. The second end of an attachment device on the fringe strip may be removably attached to the first end of an attachment device fixedly attached to the washable foundation 30. The first end of an attachment device on the fringe strip may be removably attached to the second end of an attachment device fixedly attached to the decorative costume cover 20. In this manner, the garment may work with or without the fringe. In sewn connection with the fringe strip 26 may be a plurality of fringes 28. These fringes 28 hang from the fringe strip 26. In particular, fringes 26 may also be used, ornamentally, to hold slotted jewels 29. It is envisioned that a number of different additions and changes could be made to the costuming system, including the addition of tassels, bra straps, even sleeves, or pants and skirts in the case of an underwear like washable foundation.

Figure 1B:
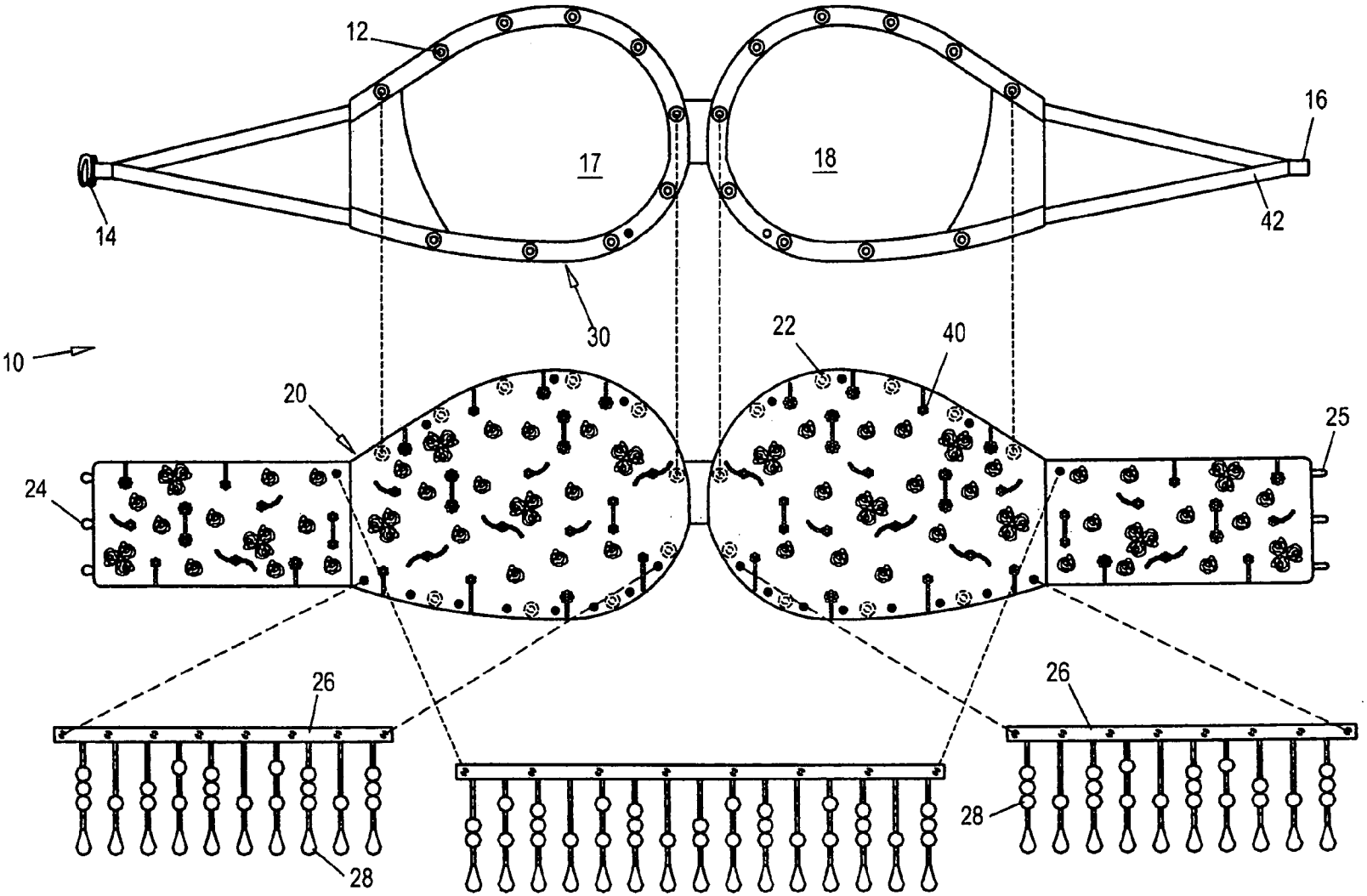
FIG. 1B is an exploded view of a brassiere according to the present invention.

FIG. 1B depicts an exploded view of the brassiere as shown in FIG. 1A to provide more detail. The washable foundation 30 consists of a right side and left side cup 17,18 respectively. Also shown are the first ends 22 of the attachment device. These first ends 22 are connected by sewing to the inside surface of the decorative cover 20. These first ends 22 are also in communication with the second ends 12 of the attachment device. According to this embodiment, the first ends 22 "snap" into the second ends 12 given a minimal amount of hand applied pressure. Thus forming a reversible rigid connection between the decorative covering 20 and the brassiere foundation 30.

Figure 2:
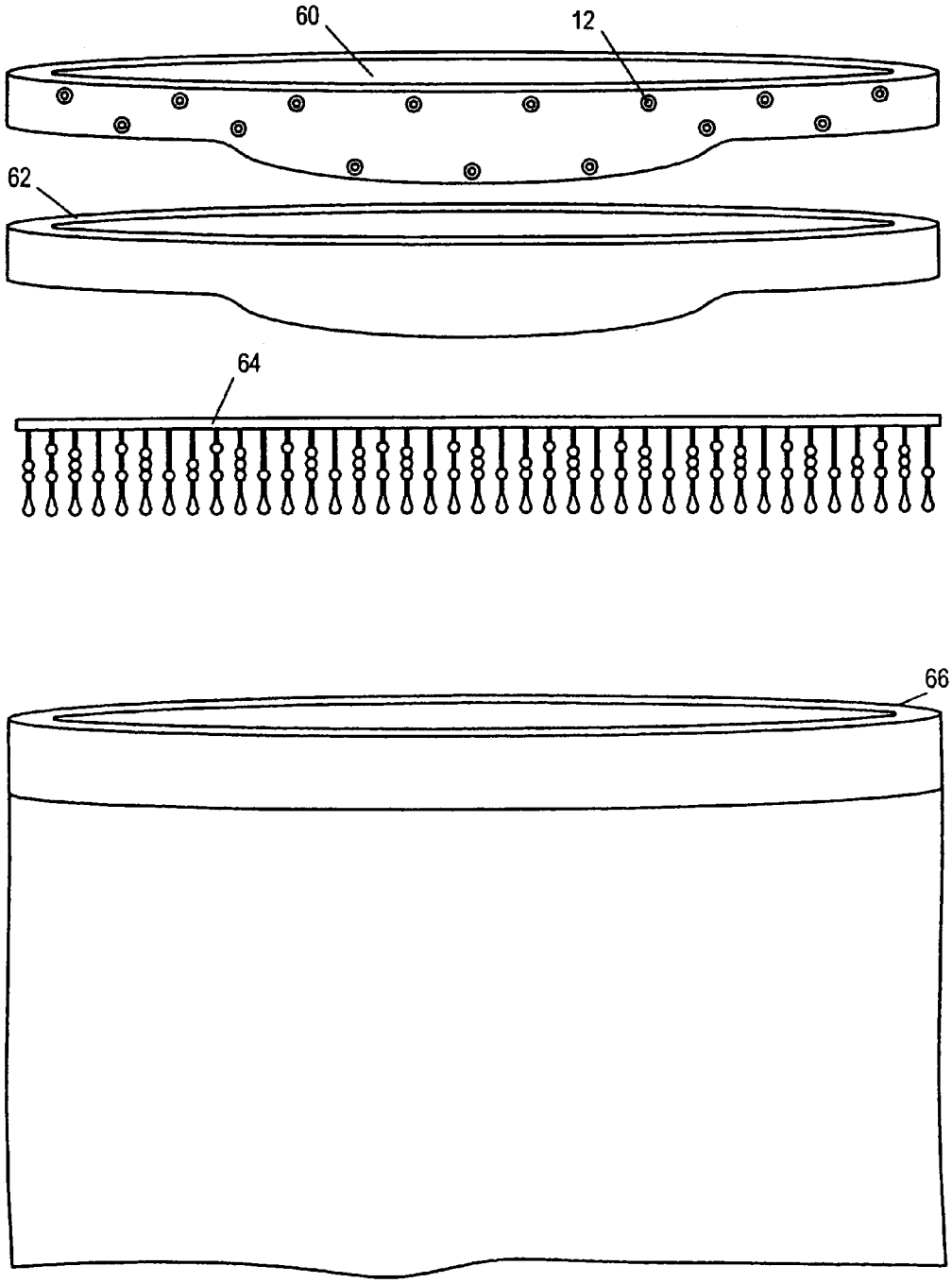
FIG. 2 is an exploded view of a belt according to the present invention.

FIG. 2 depicts a washable foundation 60. The washable foundation 60 according to this embodiment is a belt. The decorative cover 62 may be beaded, lace or any other decorative fabric which may not be suitable for washing. As shown, there may be fringe 64 as in the previous embodiment. A skirt portion 66 may be attached to the washable foundation 60 or the decorative cover 62. It is also envisioned that there may be additional decorative items such as tassels, snap on appliques, skirts and even removable legs or leg covering portions.

Figure 3:
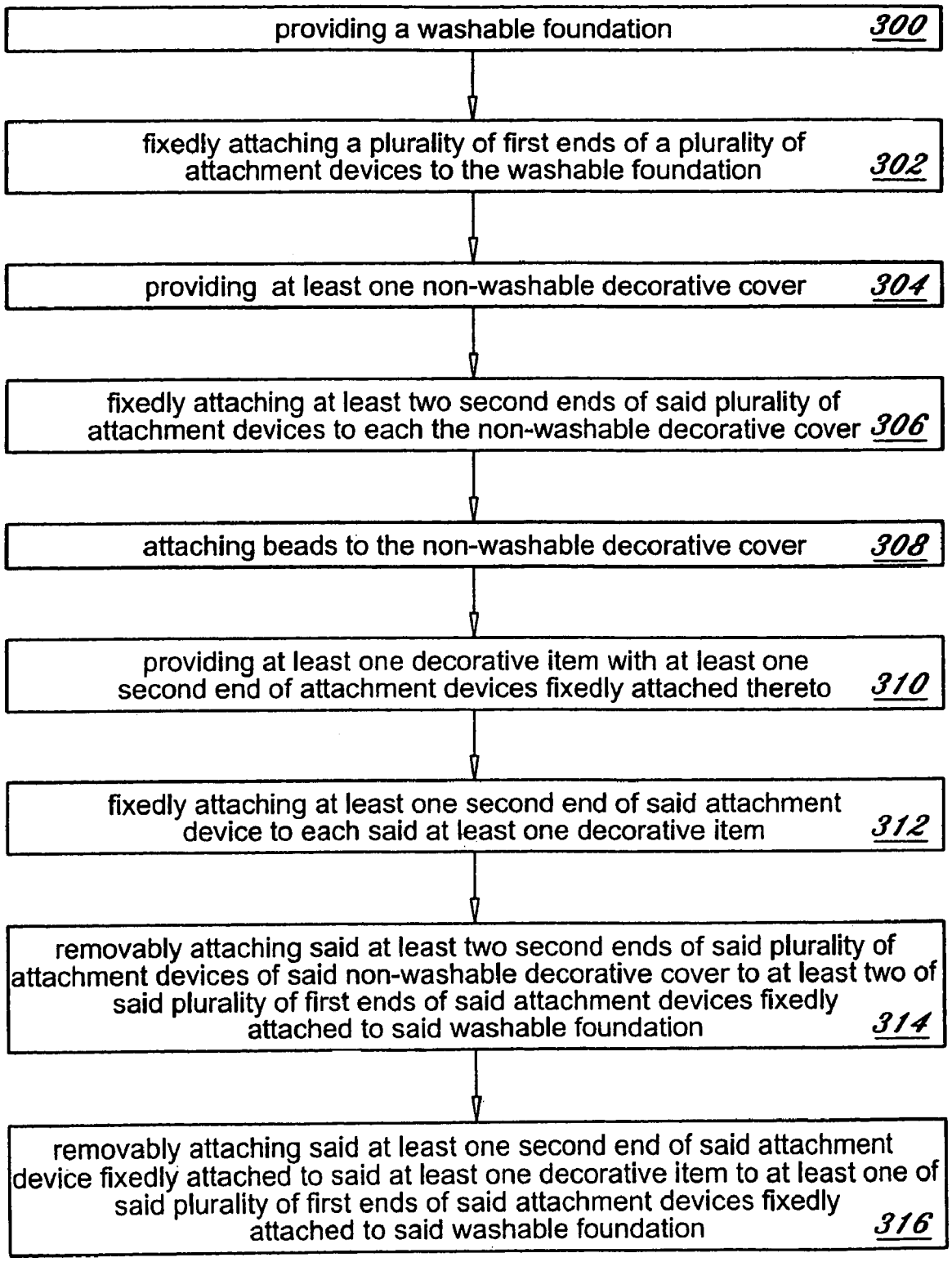
FIG. 3 is a flowchart of a method for manufacturing an interchangeable costume garment according to the present invention.

FIG. 3 depicts a flowchart of a method for manufacturing an interchangeable costume garment set according to the present invention. As shown, the method may be comprised of a number of different steps. The first step 300 may be providing a washable foundation 30. This may be a brassiere, sash, belt, scarf, shawl, hip scarf, hat, skirt or any other desired item of clothing appropriate for a performance costume. Step 302 is to fixedly attaching a plurality of first ends of a plurality of attachment devices to the washable foundation 30. According to a preferred embodiment, this may be a female portion of a snap. The next step 304 may be providing at least one non-washable decorative cover 20. The non-washable decorative cover may be made of a number of different types of materials including beaded, applique, embroidered, lace, non-washable materials and dry clean only materials Performance costumes may be very complex, with detailed broidery, beading, appliques, and the like. Step 306 is fixedly attaching at least two second ends of a plurality of attachment devices to each non-washable decorative cover 20. According to a preferred embodiment, this may be a male end of a snap. The non-washable decorative cover may already have beads or decorations already attached. However, it may also be desirable to complete step 308 attaching beads to the non-washable decorative cover 20 after the attachment devices have been fixedly attachment to the decorative cover 20.

Where it is desirable to provide additional decorative elements additional steps may be taken. Step 310 providing at least one decorative item (e.g. fringe 28) with at least one second end of attachment devices fixedly attached thereto, and step 312 fixedly attaching at least one second end of the attachment device to each at least one decorative item. Decorative items may include a bra strap, fringe, tassels. The next step 314 may be removably attaching at least two second ends of the plurality of attachment devices of the non-washable decorative cover 20 to at least two of the plurality of first ends of the attachment devices fixedly attached to the washable foundation 30. Step 316 may be removably attaching at least one second end of the attachment device fixedly attached to the decorative item to at least one of the first ends of the attachment devices fixedly attached to washable foundation 30.

Figure 4:
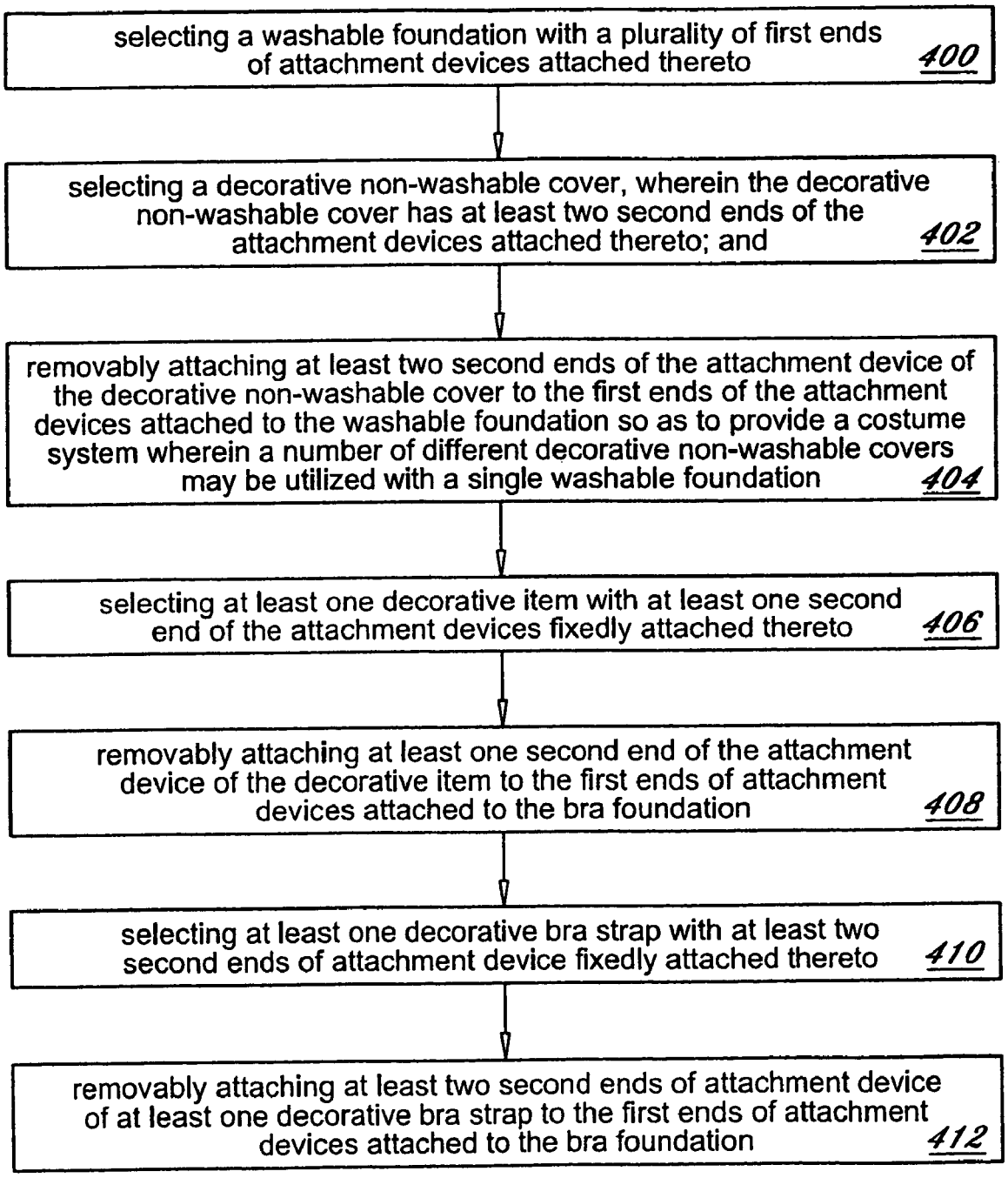
FIG. 4 is a flowchart of a method of utilizing an interchangeable costume system according to the present invention.

FIG. 4 depicts a method of utilizing an interchangeable costume or garment set. The first step 400 may be selecting a washable foundation 30 with a plurality of first ends of attachment devices attached thereto. Step 402 selecting a decorative non-washable cover 20, wherein the decorative non-washable cover 20 has at least two second ends of the attachment devices attached thereto. Step 404 is removably attaching at least two second ends of the attachment device of the decorative non-washable cover to the first ends of the attachment devices attached to the washable foundation so as to provide a costume system wherein a number of different decorative non-washable covers 20 may be utilized with a single washable foundation 30. Step 406 may be selecting at least one decorative item (e.g. fringe 28) with at least one second end of the attachment devices fixedly attached thereto. Step 408 removably attaching at least one second end of the attachment device of the decorative item to the first ends of attachment devices attached to the washable foundation 30. Optionally, Step 410 may be selecting at least one decorative bra strap with at least two second ends of attachment device fixedly attached thereto. Step 412 may be removably attaching at least two second ends of an attachment device of at least one decorative bra strap to the first ends of attachment devices attached to the bra foundation.

It should be understood, of course, that the foregoing relates to preferred embodiments of the invention and that modifications may be made without departing from the spirit and scope of the invention as set forth in the following claims.

I claim:

1. An interchangeable costuming system comprising:

at least one washable foundation with a plurality of first ends of an attachment device fixedly attached to said washable foundation, at least one non-washable costume decorative cover wherein said non-washable costume decorative cover is either made of non-washable material or dry clean only materials and said non-washable costume decorative cover has at least two second ends of an attachment device fixedly attached thereto, wherein said second ends of said attachment device are intended to removably attach said non-washable costume decorative cover to at least one of said plurality of first ends of an attachment device fixedly attached to said washable foundation so as to provide a washable garment with a non-washable costume decorative cover; and at least one non-washable costume decorative item with at least one second end of an attachment device.

2. An interchangeable costuming system as in claim 1, wherein said washable foundation is selected from the group consisting of a brassiere and belt.

3. A garment and a plurality of attachable accessories, the garment and accessories comprising an interchangeable garment set, the garment set comprising:

a brassiere foundation, said brassiere foundation having a plurality of attachment device first ends;

at least one decorative cover wherein said decorative cover is either non-washable material or dry clean only materials and each said decorative cover having at least one second end of an attachment device for removably attaching said decorative cover to said brassiere foundation; and a decorative fringe having at least one second end of an attachment device for removably attaching said decorative fringe to a portion of said garment set.

4. A garment and a plurality of attachable accessories as in claim 3, further comprising:

a decorative bra strap attached to a portion of said garment set.

5. A garment and a plurality of attachable accessories as in claim 3, further comprising:

a decorative fringe having at least one second end of an attachment device for removably attaching said decorative fringe to a portion of said garment set.

6. A garment set as in claim 3, further comprising at least one non-washable costume decorative item chosen from the group consisting of a bra strap, fringe, tassels, snap on appliqués, arm nets with fringe, sleeves, skirt, and bracelets.

7. A method for manufacturing an interchangeable costume garment set, said method comprising;

providing a washable foundation, wherein said step of providing a washable foundation is accomplished so as to form a washable foundation selected from the group consisting of a brassiere, and belt;

fixedly attaching a plurality of first ends of a plurality of attachment devices to said washable foundation;

providing at least one non-washable costume decorative cover wherein said decorative cover is non-washable and is chosen from the group consisting of beaded, appliqué, embroidered, lace, non-washable materials and dry clean only materials and;

fixedly attaching at least two second ends of said plurality of attachment devices to each said non-washable costume decorative cover;

providing at least one decorative item with at least one second end of said attachment devices fixedly attached thereto; and fixedly attaching at least one second end of said attachment device to each said at least one decorative item.

8. A method of utilizing an interchangeable costume system:

selecting a washable foundation, wherein said washable foundation has a plurality of first ends of attachment devices attached thereto;

selecting at least one decorative non-washable cover, wherein said decorative non-washable cover has at least two second ends of said attachment devices attached thereto and wherein said decorative cover is formed of either non-washable materials or dry clean only materials and;

removably attaching said at least two second ends of said attachment devices of said decorative non-washable cover to said first ends of said attachment devices attached to said washable foundation so as to provide a costume system wherein a number of different decorative non-washable covers may be utilized with a single washable foundation;

selecting at least one decorative item with at least one second end of said attachment devices fixedly attached thereto; and removably attaching said at least one second end of said attachment device of said at least one decorative item to said first ends of attachment devices attached to said washable foundation.

9. A method of utilizing an interchangeable costume system as in claim 8, wherein said step of selecting at least one decorative item is at least one decorative bra strap with at least two second ends of said attachment device.

* * * * *